United States Patent [19]

Walton

[11] 3,938,439

[45] Feb. 17, 1976

[54] CHARGE DEPLOYMENT DEVICE

[75] Inventor: John E. Walton, Camillus, N.Y.

[73] Assignee: The United States of America as represented by the Secretary of the Army, Washington, D.C.

[22] Filed: June 21, 1974

[21] Appl. No.: 481,950

[52] U.S. Cl. ..... 102/7.2; 102/69

[51] Int. Cl.[2] ..... F42B 25/16

[58] Field of Search ..... 102/7.2, 34.4, 35.6, 37.6, 102/69

[56] References Cited

UNITED STATES PATENTS

| | | | |
|---|---|---|---|
| 2,809,583 | 10/1957 | Ortynsky et al. | 102/7.2 |
| 2,874,639 | 2/1959 | Cardiff | 102/7.2 |
| 3,865,034 | 2/1975 | Boulter et al. | 102/7.2 |

*Primary Examiner*—Samuel Feinberg
*Assistant Examiner*—C. T. Jordan
*Attorney, Agent, or Firm*—Nathan Edelberg; Robert P. Gibson; Charles R. Carter

[57] ABSTRACT

A device for safe containing mini-charge rounds and controlled dispersal of the rounds by tiers into a swarm of desired size and density when actuated by a fusing signal. The device utilizes chambered gas in a series of metered pressure drops to inflate diaphragms and develop controlled forces. These forces are imposed upon the mini-charge rounds to deploy the rounds from each tier by lateral force into radial patterns expanding at different rates to provide the pattern density required.

3 Claims, 1 Drawing Figure

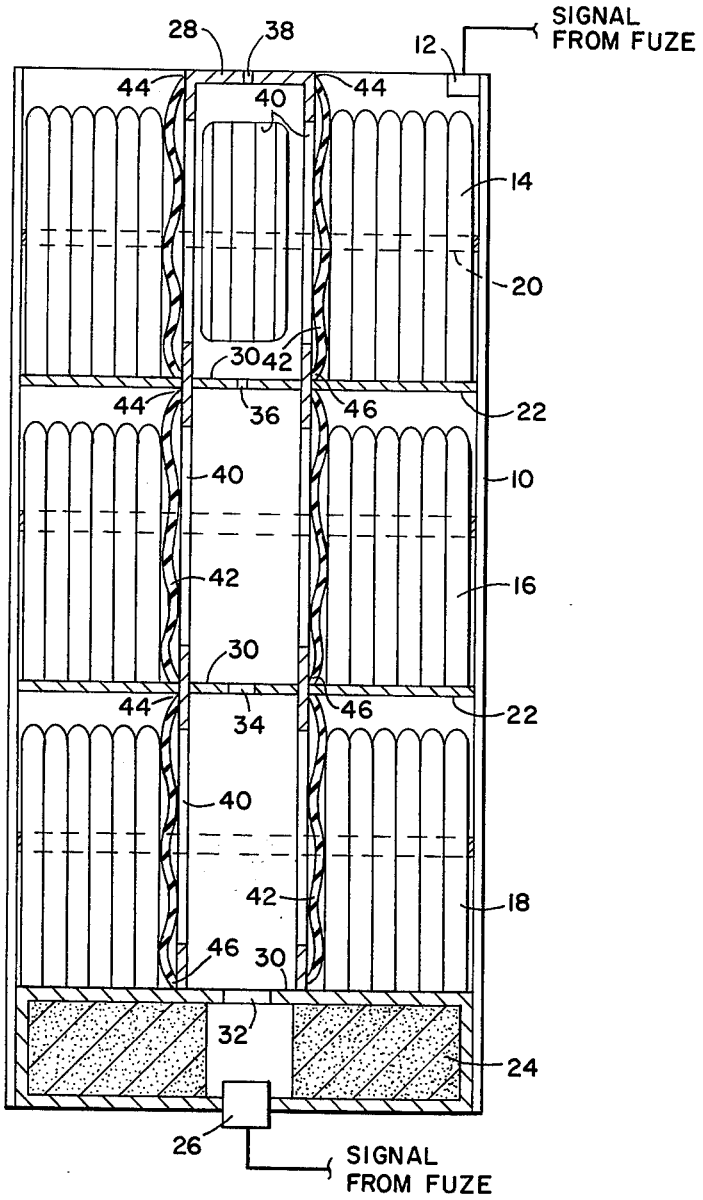
SIGNAL FROM FUZE
28
38
12
44
40
44
14
20
30
42
44
36
46
22
40
10
42
16
30
44
34
46
22
40
42
18
46
30
32
24
26
SIGNAL FROM FUZE

CHARGE DEPLOYMENT DEVICE

BACKGROUND OF THE INVENTION

This invention relates to the field of small missile deployment. Present devices rely only on windstream to disperse their rounds and lack control in the orientation of the rounds in its own axis and its position in the spacial pattern.

SUMMARY OF THE INVENTION

This invention not only uses windstream force for partial operation but also uses gas dispensed through a series of metered pressure drops to inflate diaphragms and develop controlled forces. THe forces are imposed upon the mini-charge rounds to deploy the multi-tiered rounds into patterns expanding at varying rates.

This invention may be better understood from the following detailed description taken in conjunction with the accompanying drawing.

BRIEF DESCRIPTION OF THE DRAWING

The single FIGURE shown is a sectional view of the device showing three tiers of mini-charge rounds in a sectional case.

DESCRIPTION OF THE PREFERRED EMBODIMENT

Reference numeral 10 indicates a sectional enclosing case that is latched together at 12. The case encloses three tiers of mini-charge rounds identified as 14, 16 and 18. In each tier the rounds are held in a tight circular arrangement for assembling by a light retaining band 20 and are separated by stops 22. The lower tier 18 is supported on a gas generator 24 which is ignited by primer 26. Both the latch 12 and primer 26 are connected to a fuse (not shown) for actuation thereby. A cylindrical tube 28 is positioned on the gas generator for transmitting gas produced from the generator. The tube extends through the center of each tier to the upper end of case 10. Restrictions 30 are placed inside of the tube 28 to provide horizontal orifices 32, 34, 36, and 38 of progressively smaller diameters. The tube 28 is provided with lateral openings 40 at each tier level within the enclosing case. A resilient cylindrical diaphragm 42 is attached to tube 28 at points 44 and 46 of each tier level and encloses the lateral tube openings at their particular tier level. Through this arrangement, therefore developed gas flows successivley from the gas generator 24 through orifices 32, 34, 36 and 38, taking controlled pressure drops through each orifice.

In operation an enclosing case is carried by a missile to a designated area and a signal from the fuse releases latch 12 and unlatches the case sections permitting it to fly off from the force of the windstream. The fusing signal also initiates the primer 26 which in turn ignites the gas generator 24. The developed gas flows successively through pressure drop orifices 32, 34, 36 and 38. As the gas builds up in tube 28 it is transmitted through lateral wall openings 40 to the sealed collapsible diaphragms 42, where it is enclosed and builds up a pressure force therein. THe pressure and force on each diaphragm is proportional to the pressure drops across the orifices. These pressure drops are selected to provide the force required to cause the diaphragms to expand and break bands 20 and to give motion to the rounds in respective tiers and form radially expanding tiers as desired.

I claim:

1. A device for deploying multi-tiered charged rounds into radial patterns expanding at different rates therefrom, said device comprising: a sectional enclosing case; stops in said device to separate each tier of charged rounds from a succeeding tier; a gas generator associated with said case for producing gas; a tube disposed on said generator, said tube being provided with a plurality of lateral openings spaced longitudinally of said tube; a plurality of cylindrical resilient diaphragms, each diaphragm being attached to the tube at points enclosing a horizontal set of lateral tube openings and a plurality of internal restrictions in said tube that provide progressively sized horizontal orifices for developing the controlled forces to deploy said tiered rounds into radially expanding patterns.

2. A device as set forth in claim 1 wherein said sectional enclosing case is provided with a latch for holding and releasing said case into its separate sections.

3. A device as set forth in claim 2 including a primer for igniting said gas generator.

* * * * *